US009347744B2

(12) United States Patent
Lampe

(10) Patent No.: US 9,347,744 B2
(45) Date of Patent: May 24, 2016

(54) CAMOUFLAGE FOR DAY AND NIGHT USE

(71) Applicant: Jeffrey L Lampe, Rocheport, MO (US)

(72) Inventor: Jeffrey L Lampe, Rocheport, MO (US)

( * ) Notice: Subject to any disclaimer, the term of this patent is extended or adjusted under 35 U.S.C. 154(b) by 0 days.

(21) Appl. No.: 14/530,487

(22) Filed: Oct. 31, 2014

(65) Prior Publication Data

US 2015/0047094 A1 Feb. 19, 2015

Related U.S. Application Data

(63) Continuation of application No. 12/353,759, filed on Jan. 14, 2009, now abandoned.

(60) Provisional application No. 61/021,228, filed on Jan. 15, 2008.

(51) Int. Cl.

| | |
|---|---|
| ***F41H 3/00*** | (2006.01) |
| ***A41D 13/00*** | (2006.01) |
| ***A41D 13/01*** | (2006.01) |
| ***A41B 9/00*** | (2006.01) |
| ***A41D 1/02*** | (2006.01) |
| ***A41D 1/06*** | (2006.01) |
| ***A41D 19/00*** | (2006.01) |
| ***A41D 23/00*** | (2006.01) |
| ***A42B 1/00*** | (2006.01) |
| ***B05D 5/06*** | (2006.01) |
| *A41D 31/00* | (2006.01) |
| *A41D 27/08* | (2006.01) |

(52) U.S. Cl.

CPC .. *F41H 3/00* (2013.01); *A41B 9/00* (2013.01); *A41D 1/02* (2013.01); *A41D 1/06* (2013.01); *A41D 13/01* (2013.01); *A41D 19/0051* (2013.01); *A41D 23/00* (2013.01); *A42B 1/004* (2013.01); *B05D 5/063* (2013.01); *A41D 27/08* (2013.01); *Y10T 428/24802* (2015.01)

(58) Field of Classification Search

CPC ..... F41H 3/00; F41H 3/02; Y10S 428/919; Y10S 2/90; Y10S 428/913; A41D 13/00; A41D 31/0011; A41D 13/01; D06P 1/44; D06P 1/004; D06P 5/003; B41M 1/14; B44F 3/00; B44F 5/00; B44F 7/00; B44F 9/00

USPC ..... 2/900; 114/15; 428/919, 195.1

See application file for complete search history.

(56) References Cited

U.S. PATENT DOCUMENTS

| | | | | |
|---|---|---|---|---|
| 2,190,691 A * | 2/1940 | McClelland | ..... | 427/280 |
| 2,292,848 A * | 8/1942 | Robson | ..... | 114/15 |
| 2,362,786 A * | 11/1944 | Williams | ..... | 428/90 |

(Continued)

FOREIGN PATENT DOCUMENTS

WO 2005101300 10/2005

OTHER PUBLICATIONS

Office Action from related U.S. Appl. No. 29/354,066, issued Jul. 23, 2010, 10 pages.

(Continued)

*Primary Examiner* — Bobby Muromoto, Jr.

(74) *Attorney, Agent, or Firm* — Lathrop & Gage LLP

(57) ABSTRACT

Camouflage articles are formed of arrangements of portions of different colors. The lighter colored portions or parts thereof are formed of reflective ink in that particular color. This arrangement provides the article with a camouflage appearance, altering depth perception by animals in daylight, and reflectivity at night for safety.

20 Claims, 4 Drawing Sheets

(56) References Cited

U.S. PATENT DOCUMENTS

| | | | | |
|---|---|---|---|---|
| 2,641,554 | A * | 6/1953 | Meunier et al. | 427/288 |
| 3,069,796 | A * | 12/1962 | Benisch et al. | 428/17 |
| 3,716,326 | A * | 2/1973 | Dutta et al. | 8/480 |
| 3,967,026 | A * | 6/1976 | Dalblom | 428/195.1 |
| 4,089,491 | A * | 5/1978 | Ferris | 244/1 R |
| 4,153,412 | A * | 5/1979 | Bailey | 8/471 |
| 4,243,709 | A * | 1/1981 | Morton | 428/195.1 |
| 4,285,068 | A * | 8/1981 | Ross | 2/202 |
| 4,576,904 | A * | 3/1986 | Anitole | 430/347 |
| 4,656,065 | A * | 4/1987 | Yacovella | 428/17 |
| 4,659,602 | A * | 4/1987 | Birch | 428/88 |
| 4,767,649 | A * | 8/1988 | Birch | 428/99 |
| 4,865,900 | A * | 9/1989 | Shannon et al. | 428/195.1 |
| 4,868,019 | A * | 9/1989 | Knickerbocker | 428/17 |
| 5,043,202 | A * | 8/1991 | Knickerbocker | 428/195.1 |
| 5,409,760 | A * | 4/1995 | Neitz et al. | 428/195.1 |
| 5,753,323 | A * | 5/1998 | Andrus | 428/17 |
| 6,127,022 | A * | 10/2000 | Pretorius | 428/195.1 |
| 6,701,649 | B1 | 3/2004 | Brosi | |
| D527,191 | S | 8/2006 | Sparkes | |
| D538,050 | S | 3/2007 | Tardif | |
| D572,909 | S | 7/2008 | Crye et al. | |
| D592,861 | S | 5/2009 | Crye et al. | |
| D615,762 | S | 5/2010 | Kimmel | |
| D616,207 | S | 5/2010 | Weng | |
| 2002/0110652 | A1* | 8/2002 | Conk | 428/15 |
| 2004/0143883 | A1* | 7/2004 | Grilliot et al. | 2/93 |
| 2004/0166293 | A1* | 8/2004 | Clausen et al. | 428/195.1 |
| 2004/0194188 | A1* | 10/2004 | Tooley | 2/69 |
| 2004/0202846 | A1* | 10/2004 | Conk | 428/195.1 |
| 2004/0209051 | A1* | 10/2004 | Santos et al. | 428/195.1 |
| 2004/0213982 | A1* | 10/2004 | Touzov | 428/304.4 |
| 2005/0118402 | A1* | 6/2005 | Henderson et al. | 428/209 |
| 2005/0276955 | A1* | 12/2005 | Tooley | 428/195.1 |
| 2006/0222827 | A1* | 10/2006 | Marshall et al. | 428/195.1 |
| 2007/0190368 | A1* | 8/2007 | Jung et al. | 428/919 |
| 2007/0292662 | A1* | 12/2007 | Johnson | 428/195.1 |
| 2008/0095990 | A1* | 4/2008 | Boone et al. | 428/195.1 |
| 2008/0261002 | A1 | 10/2008 | Sloot | |
| 2009/0313740 | A1* | 12/2009 | Santos et al. | 2/69 |

OTHER PUBLICATIONS

Response to Office Action in related U.S. Appl. No. 29/354,066 dated Aug. 4, 2010, 5 pages.

3M Relfective Ink for Textiles—Series 8000, Technical Data Sheet, Sep. 2002, 2 pages.

3M Laboratories (Europe) Gmgh Certificate for 3M Scotchlite, Jan. 31, 2001, 1 page.

Vermont's Barre Army Navy, "Multicam Hunting Shirt-2 pocket" 2007, 2 pages.

Vermont's Barre Army Navy, "Multicam Hunting Pants" 2007, 2 pages.

Vermont's Barre Army Navy "Multicam Ball Cap" 2007, 2 pages.

CafePress.com "Printing Process" Jan. 11, 2008, 2 pages.

One Stroke "Safety Gray Relecto-Reflective Inc," 2 pages, date unknown.

International Coating "Water Base Products" 3 pages, date unknown.

Optilun Ultra Reflective Ink Systems "Optilux Application" 2 pages, date unknown.

Sericol "Reflec 200 Product Information" 2 pages, date unknown.

* cited by examiner

CAMOUFLAGE FOR DAY AND NIGHT USE

CROSS REFERENCES TO RELATED APPLICATIONS

This application is a continuation of U.S. patent application Ser. No. 12/353,759, filed Jan. 14, 2009, which claims priority to commonly owned U.S. Provisional Patent Application Ser. No. 61/021,228, entitled: Camouflage For Day And Night Use, filed Jan. 15, 2008, the disclosures of which are incorporated by reference in their entireties herein.

TECHNICAL FIELD

The disclosed subject matter is directed to camouflage, and articles that are camouflaged. In particular, the disclosed subject matter is directed to camouflage for articles with camouflage patterns incorporating reflective materials into the patterns, such that the article is of a camouflage pattern by day and is reflective at night or other periods of darkness.

BACKGROUND

Camouflage is well known to the animal and human kingdoms. Many species of animals are naturally camouflaged to blend into their surroundings as a defense against predators. Camouflage has been used for centuries to conceal the user from humans, animals and the like.

Today, as in the past, camouflage finds its greatest uses in military and hunting applications. For example, in hunting, hunters typically wear clothes with one or more camouflage patterns to blend in with the surroundings, so as not to be visible by the animals being hunted. Typical camouflage patterns for hunting employ splotches of brown, black and green in different shades with splotches of whites, grays and lighter greens throughout the pattern. Other camouflage patterns are designed to mimic those of a forest, woods or trees. For example, camouflage patterns mimicking natural foliage are sold under the names Real Tree® and Mossy Oak®. As a result of this camouflage, game animals, typically deer, see the camouflaged hunter as a three dimensional object that is part of the forest or woods, rather than as another animal or potential threat.

For example, FIG. 1 shows a conventional hunting camouflage garment. This garment is a shirt 10 printed with a camouflage pattern.

As prime hunting times are at dusk, when day is turning to night, and at dawn, when night is turning to day, hunter safety is critical in darkness. While the camouflage is effective during periods of light, it presents a hazard during low light conditions, when hunters may be moving, but are not hunting.

Although hunters wear blaze orange clothing to be visible to other hunters, motorists, or other passers by, especially during hours of darkness, the blaze orange clothing is detectable by animals. This diminishes the value of the camouflage that must be covered in the blaze orange, to increase safety. Also, even if the hunter removes the blaze orange articles of clothing, he still must carry it, creating an unnecessary burden.

SUMMARY

The present disclosed subject matter provides for camouflage articles that serve as camouflage during daylight, allowing the user to blend in to his surroundings, and provide reflection to light, for example, visible light, such as from lamps, lights, vehicle headlights, flashlights, floodlights and search lights, and the like, during night, darkness, or other periods of low light (e.g., dawn and dusk) for safety. The reflective portions are part of the actual camouflage pattern, such that the camouflage pattern appears unaltered on the article. The reflective portions are formed of reflective ink or other reflective material, that forms a part of or all of the portion or element (portions and elements of the camouflage pattern are used interchangeably herein) of a color, in the camouflage pattern.

The reflective material, such as reflective ink, also contributes to the deception effect, as viewed by animals, such as deer, as produced by the camouflage pattern. Specifically, the reflective ink in the camouflage pattern alters the depth of field as viewed by the animal, further enhancing the effectiveness of the camouflage.

The disclosed subject matter includes a camouflage pattern. The pattern includes a plurality of portions, each portion including a color selected from at least two different colors, at least one portion being of a color different than the color of at least one other portion, and at least one color is formed of reflective material, e.g., reflective ink. The camouflage pattern may be on an article and the article may be, for example, garments, such as shirts, pants, gloves, scarves, hats, caps, headbands, coats, jackets and underwear.

The disclosed subject matter is also directed to camouflage articles. The articles include a plurality of portions, each of the portions being of one color selected from at least two different colors, and at least one portion or a part thereof includes reflective ink corresponding to the color of the at least one portion. The articles may be, for example, garments, clothing, headwear, footwear and the like, such as shirts, pants, gloves, scarves, hats, caps, headbands, coats, jackets and underwear.

Another embodiment is directed to a camouflage article including a plurality of portions, each of the portions being of one color selected from at least two different colors. At least a part of the at least one portion is reflective in the color corresponding to the color of the at least one portion. The at least two colors is more than two colors.

Another embodiment is directed to a camouflage article. The article includes a camouflage pattern formed of a plurality of elements, at least a portion (part) of each element of either of a first or second color, with at least a portion (part) of an element of the first color being of a reflective material.

Another embodiment is directed to a method of making a camouflage article. The method includes providing an article, and providing at least a part of the article with a camouflage pattern formed of multiple portions or elements, at least one portion or element of a first color and at least one portion or element of a second color, the first color different from the second color, and at least one portion or element of the first color or the second color of a reflective material. The article may be, for example, garments, fabrics, materials, apparatus and the like.

BRIEF DESCRIPTION OF THE DRAWINGS

Attention is now directed to the drawing figures, where like or corresponding numerals or characters indicate corresponding or like components. In the drawings.

DETAILED DESCRIPTION

Figure 2A:
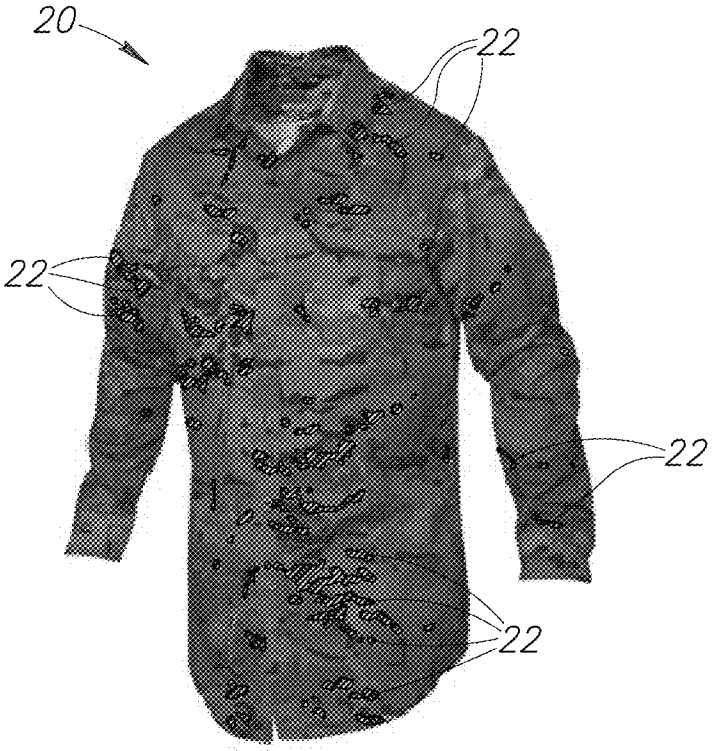
FIGS. 2A and 2B are drawings of front and rear views of a camouflage garment in accordance with the disclosed subject matter; and, FIGS. 3A and 3B are drawings of exemplary camouflage patterns in accordance with the disclosed subject matter.
Figure 1:
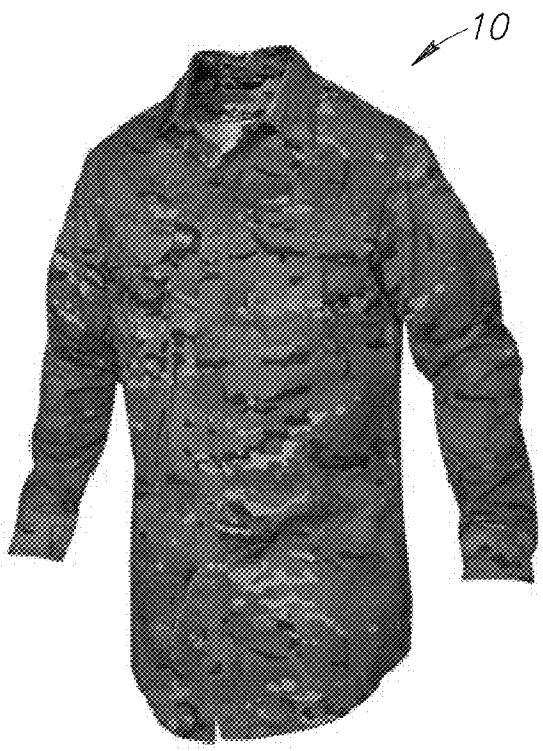
FIG.1 PRIOR ART
FIG. 1 is a drawing of a camouflage garment in accordance with the prior art.
Figure 2B:
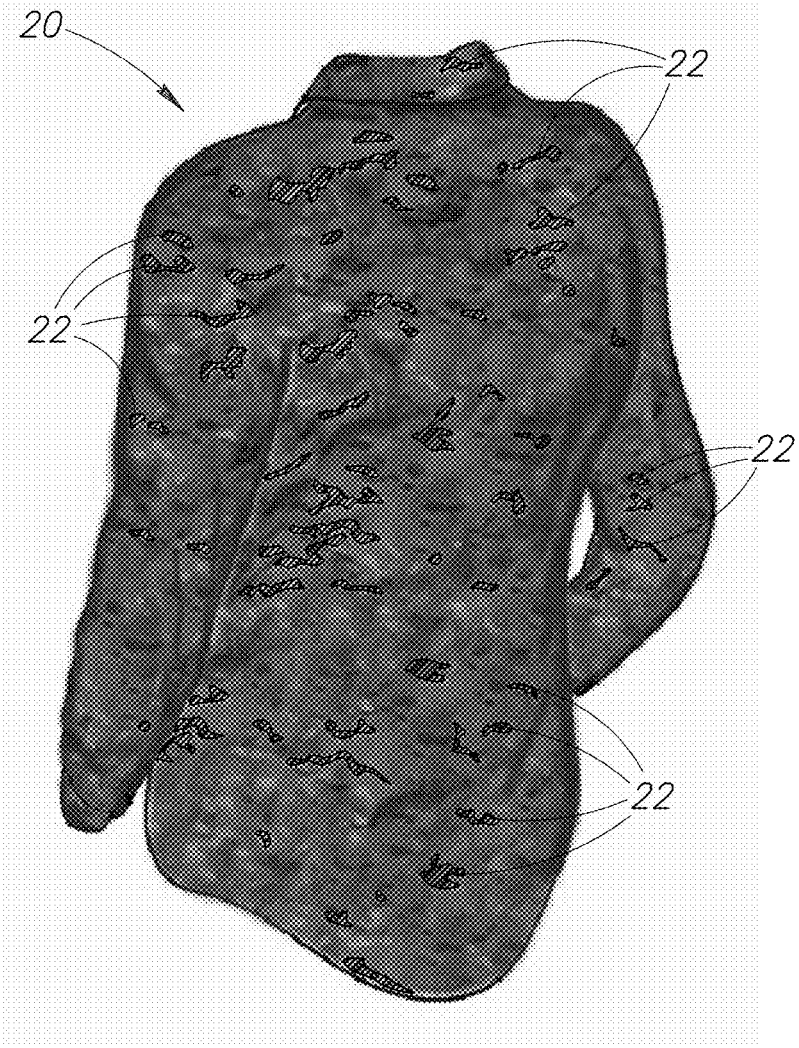

FIGS. 2A and 2B show a garment or article, for example, a camouflage shirt 20 imprinted with a camouflage pattern. The camouflage pattern is formed of various colors, dark colors such as brown, black, dark green, and lighter colors, and all variations in hue thereof, such as light green, gray, white, and all variations in hue thereof. For example, the colors are in the form of portions or elements that form the camouflage pattern. These portions or elements are, for example, of a single color. Also, for example, the portions or elements may be splotches, that are arranged amongst other splotches or over a base matrix, to form the requisite camouflage pattern on the article.

For example, one or more of the lighter colors (all or a part thereof of the portion or element of that particular color in the camouflage pattern), may be of a reflective material, for example, reflective ink (also known as retro-reflective or retroreflective ink). The reflective ink is reflective to light (e.g., visible light, such as that from lamps, lights, vehicle headlights, flashlights, floodlights and search lights) that contacts it, at night or during other dark and partially dark or low light periods. For example, all or part of the elements (portions of the pattern) of a light color, such as the elements of a white color 22 (shown as shaded for explanation purposes) may be colored by a white reflective ink. The remaining colors of the garment (e.g., in elements or portions of the camouflage pattern), for example, gray, light green, dark green, brown and black, may be of conventional inks, dyes, pigments or the like.

Figure 3A:
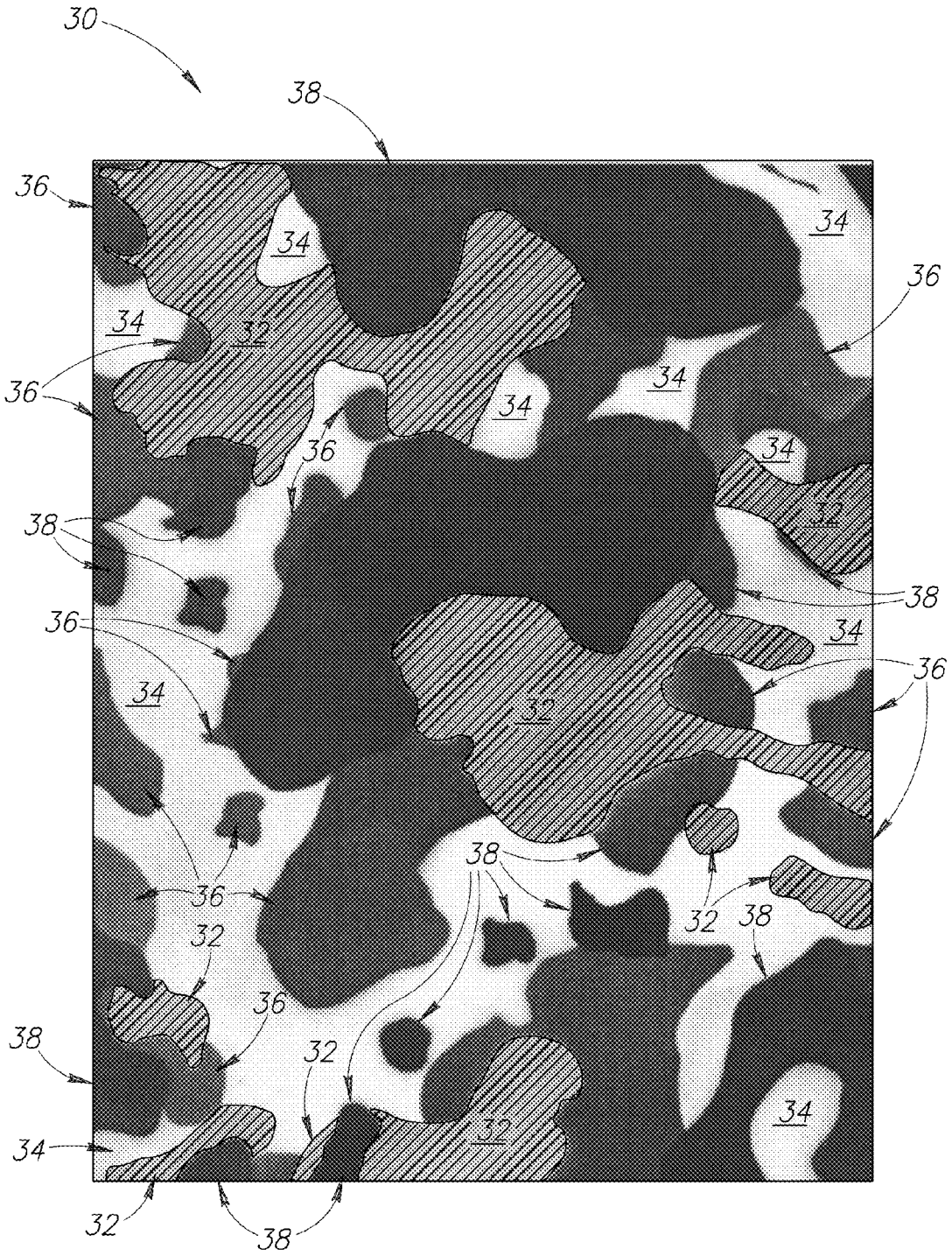
Figure 3B:
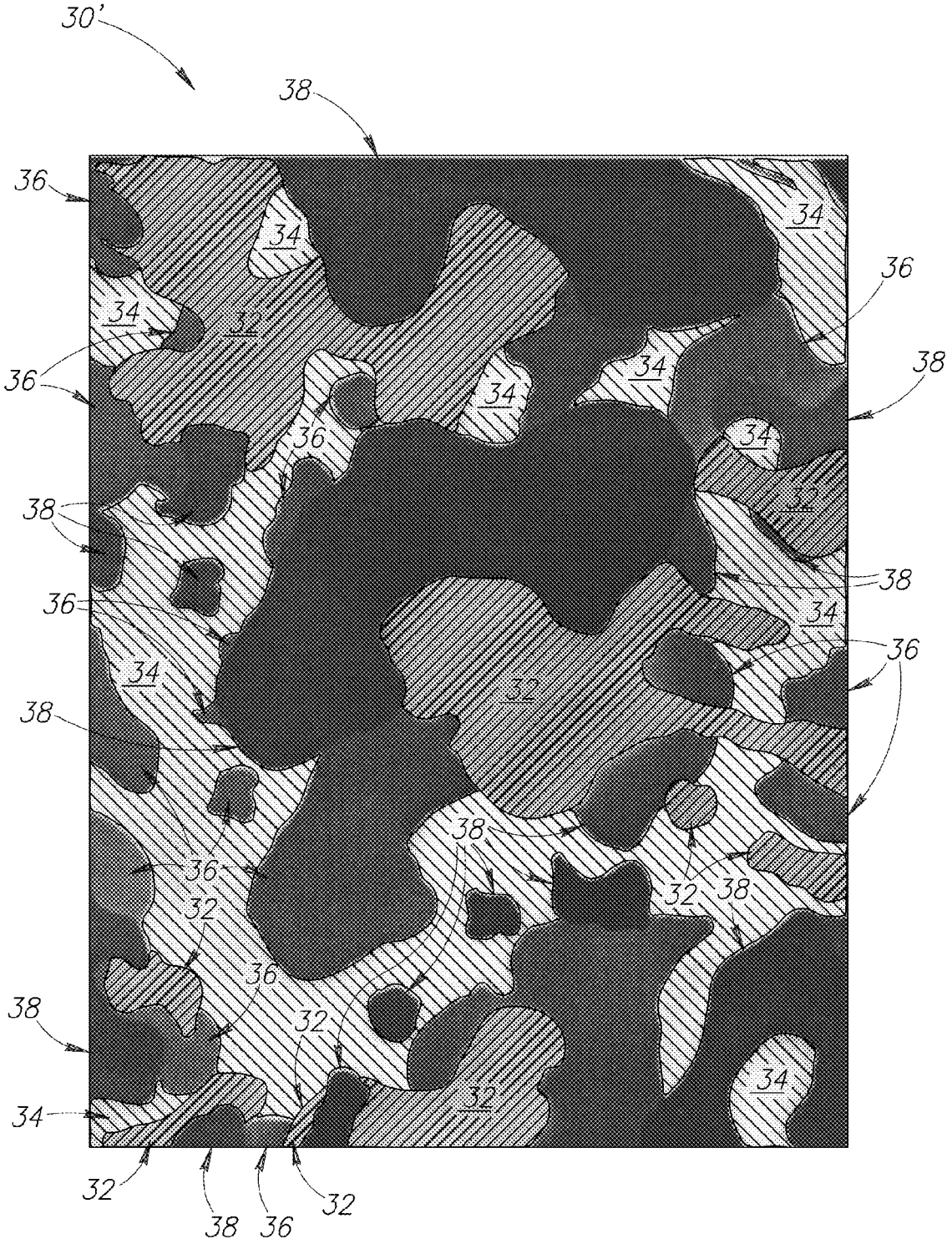

Similarly, in a camouflage pattern 30, 30', shown in FIGS. 3A and 3B, respectively, useful on the articles mentioned herein, one or more colors, in their respective potions, or parts thereof, of the pattern 30, 30' may be of reflective ink in the respective color. For example, in the pattern 30 of FIG. 3A, the gray portions 32 (shown as shaded for explanation purposes) of the pattern 30 are in gray reflective ink (along with portions of white 34, light green 36 and dark green 38, for example, of conventional ink, dye, coloration or pigment), while in the pattern 30' of FIG. 3B, the gray 32 and white 34 portions of the pattern (both shown as shaded for explanation purposes) are in gray and white reflective ink, respectively. The light green 36 and dark green 38 portions are, for example, of conventional ink, dye, coloration, or pigment.

While the lighter colors are typically in reflective ink, any of the other colors, including the darker colors of the camouflage pattern (for example, one or more of the darker colors), and combinations of the lighter and darker colors, may be in reflective ink. This may be for the entire potion of the color or just a part of the portion (element), as detailed above.

The reflective ink may be, for example, gray reflective ink such as Safety Gray Reflecto reflective ink from One Stroke Inks of Louisville, Ky., and Product 8010 of Series 8000 Reflective Ink for Textiles, from 3M, St. Paul, Min. 55144. Other suitable inks include white reflective ink, such as Product 8015 of Series 8000 Reflective Ink for Textiles, from 3M, St. Paul, Min. 55144.

Additional suitable reflective inks include, for example, other inks of the Series 8000 Reflective Ink for Textiles, from 3M, St. Paul, Min. 55144. Still other exemplary inks include Aquasoft® 407LF Reflective Base and 409LF Reflective Ink, from International Coatings, Cerritos, Calif. 90702, Optilux™ 505 ink and Optilux™ Ultra Max reflective ink, from International Coatings, Cerritos, Calif. 90702, and Reflec 200 retro-reflective screen inks, from Sericol Limited, Kent CT.10 2LE, England, all pigmented to the color desired.

While the reflective ink is shown in a random arrangement according to the camouflage pattern, the reflective ink may also be printed onto the article in the respective portion (in the same or different colors) so as to form a pattern, word or word groups, geometry, symbol, object, form, figure, other recognizable indicator, or the like.

The reflective ink is, for example, used for the entire potion (entire element) of the assigned color of the camouflage pattern, but could also be used for a part of the portion (element) of the assigned color of the camouflage pattern. The reflective ink is applied to the article, apparatus, etc., as part of the camouflage pattern, by techniques such as screen printing, hot split transfer, flexography, lithograph, off-set curable, rotary screen, gravure, photocopy, thermography, dye-sublimation, laser printing, ink-jet printing, digital printing, electrostatic applications, embossing, engraving, air-brushing, and the like.

While the disclosed camouflage is shown on articles such as clothing, and garments, including shirts, pants, gloves, scarves, hats, caps, headbands, coats, jackets and underwear. It is also usable on headwear, such as hats and caps, footwear, such as shoes, boots, and the like, and other articles, such as luggage, motor vehicles, fabrics, tarps, tents, service wear, such as plates, cups, glasses, cooking utensils, buildings, and portions thereof, such as walls, roofs, doors, windows, awnings, canopies, building materials, aircraft, ships, furniture, such as tables and chairs, and any other article that is suitable for being camouflaged.

While preferred embodiments of the disclosed subject matter have been described, so as to enable one of skill in the art to practice the present disclosed subject matter, the preceding description is intended to be exemplary only. It should not be used to limit the scope of the disclosed subject matter, which should be determined by reference to the following claims.

What is claimed is:

1. An object comprising:

a surface having a camouflaged pattern, the camouflaged pattern having:

a first non-symmetrical portion having a first color;

a second non-symmetrical portion having a second color, the second color being different from the first color; and a third non-symmetrical portion having a third color, the third color being different from the first and second colors, at least a section of the third portion being colored with a retroreflective ink;

wherein each of the first, second, and third non-symmetrical portions engage at least one of the respective other non-symmetrical portions and collectively provide an obscuring effect in lighted environments; and wherein the third non-symmetrical portion conspicuously reflects light in dark environments.

2. The object of claim 1, further comprising a fourth non-symmetrical portion having a fourth color colored with retroreflective ink and substantially reflecting light back to a light source in dark environments, the fourth color being different from the third color, the fourth color being selected from the group consisting of: the first color, the second color, and a color different from the first and second colors.

3. The object of claim 2, further comprising a fifth non-symmetrical portion having a fifth color, the fifth color being selected from the group consisting of all colors except for the first and second colors.

4. The object of claim 3, wherein the first, second, and fifth colors are respectively defined by at least one item selected from the group consisting of inks, dyes, colorations, and pigments.

5. The object of claim 4, wherein at least two of the colors selected from the group consisting of the first color;

the second color; and the fifth color are variations in hue from one another.

6. The object of claim 3, wherein:

the first non-symmetrical portion has a plurality of distinct areas separated from one another;

the second non-symmetrical portion has a plurality of distinct areas separated from one another;

the third non-symmetrical portion has a plurality of distinct areas separated from one another;

the fourth non-symmetrical portion has a plurality of distinct areas separated from one another; and the fifth non-symmetrical portion has a plurality of distinct areas separated from one another.

7. The object of claim 6, wherein the object is a garment selected from the group consisting of shirts, pants, gloves, scarves, hats, caps, headbands, coats, jackets, and underwear.

8. The object of claim 7, wherein all the non-symmetrical portions collectively mimic natural foliage in lighted environments.

9. The object of claim 7, wherein all the non-symmetrical portions collectively mimic at least one item selected from the group consisting of a forest, woods, and a tree in lighted environments.

10. The object of claim 7, wherein the first, second, third, fourth, and fifth colors are each selected from the group consisting of: black, hues of brown, hues of green, hues of white, and hues of gray.

11. The object of claim 1, further comprising a fourth non-symmetrical portion having a fourth color, the fourth color being selected from the group consisting of all colors except for the first and second colors.

12. The object of claim 11, wherein the colors with unexceptional reflectivity are respectively defined by at least one item selected from the group consisting of inks, dyes, colorations, and pigments.

13. The object of claim 1, wherein the second color is a variation in hue from the first color.

14. The object of claim 1, wherein:

the first non-symmetrical portion has a plurality of distinct areas separated from one another;

the second non-symmetrical portion has a plurality of distinct areas separated from one another; and the third non-symmetrical portion has a plurality of distinct areas separated from one another.

15. The object of claim 1, wherein the object is selected from the group consisting of shirts, pants, gloves, scarves, hats, caps, headbands, coats, jackets, underwear, headwear, footwear, tarps, and tents.

16. A method of making a camouflage article, the method comprising:

possessing an article;

providing at least part of the article with a camouflage pattern having first and second non-symmetrical portions that engage one another and collectively provide an obscuring effect in lighted environments, the first portion having a first color with unexceptional reflectivity, the second portion having a second color different from the first color and being retroreflective in dark environments; and providing the camouflage pattern further comprises providing a third non-symmetrical portion of the pattern;

the first, second, and third portions collectively provide an obscuring effect in lighted environments; and the third portion has a third color;

wherein the third color is different from the second color and is conspicuously light-reflective in dark environments, retroreflective ink defining the third color.

17. The method of claim 16, wherein providing the second portion comprises applying the retroreflective ink to the article using at least one technique selected from the group consisting of screen printing, hot split transfer, flexography, lithograph, off-set curable, rotary screen, gravure, photocopy, thermography, dye-sublimation, laser printing, ink-jet printing, digital printing, electrostatic applications, embossing, engraving, air-brushing, and combinations thereof.

18. The method of claim 16, wherein the third color is different from the first color and has unexceptional reflectivity.

19. The method of claim 16, wherein the article is selected from the group consisting of shirts, pants, gloves, scarves, hats, caps, headbands, coats, jackets, underwear, headwear, footwear, tarps, and tents.

20. The camouflaged object of claim 1, wherein the third color is selected from the group consisting of brown, black, and dark green.

* * * * *